US008115495B2

(12) United States Patent
Harmon

(10) Patent No.: US 8,115,495 B2
(45) Date of Patent: Feb. 14, 2012

(54) WIRED PIPE SIGNAL TRANSMISSION TESTING APPARATUS AND METHOD

(75) Inventor: Aaron B. Harmon, Provo, UT (US)

(73) Assignee: Intelliserv, L.L.C., Houston, TX (US)

( * ) Notice: Subject to any disclaimer, the term of this patent is extended or adjusted under 35 U.S.C. 154(b) by 515 days.

(21) Appl. No.: 12/356,630

(22) Filed: Jan. 21, 2009

(65) Prior Publication Data

US 2010/0182012 A1 Jul. 22, 2010

(51) Int. Cl.
*G01R 31/02* (2006.01)
*E21B 47/00* (2006.01)

(52) U.S. Cl. ..... 324/537; 175/40

(58) Field of Classification Search ..... 324/537, 324/500; 175/26, 40, 50, 320; 166/242.1, 166/242.6, 380; 411/81, 378, 411, 412, 427
See application file for complete search history.

(56) References Cited

U.S. PATENT DOCUMENTS

| | | | | |
|---|---|---|---|---|
| 3,726,180 | A * | 4/1973 | Rosan, Sr. | 411/422 |
| 6,322,307 | B1 * | 11/2001 | Glover | 411/412 |
| 6,670,880 | B1 * | 12/2003 | Hall et al. | 336/132 |
| 6,857,612 | B2 * | 2/2005 | Goodbred | 248/429 |
| 7,025,130 | B2 * | 4/2006 | Bailey et al. | 166/65.1 |
| 7,096,961 | B2 * | 8/2006 | Clark et al. | 166/380 |
| 7,823,639 | B2 * | 11/2010 | Braden | 166/242.6 |
| 2007/0036634 | A1 * | 2/2007 | Lung | 411/412 |
| 2008/0050200 | A1 * | 2/2008 | Su | 411/411 |

* cited by examiner

*Primary Examiner* — Hoai-An D Nguyen
(74) *Attorney, Agent, or Firm* — Conley Rose, P.C.

(57) ABSTRACT

A wired pipe signal transmission testing apparatus is provided. The apparatus includes a core having a plurality of threads formed on a surface thereof and a plurality of slots cutting through crests and roots of at least a portion of the threads, thereby creating an escape route for debris that may enter in between the threads. The apparatus includes an inductive transducer coupled to the core.

17 Claims, 4 Drawing Sheets

WIRED PIPE SIGNAL TRANSMISSION TESTING APPARATUS AND METHOD

FIELD

The invention relates generally to borehole telemetry systems. More specifically, the invention relates to an apparatus and a method for testing the ability of a wired pipe or string of wired pipes to transmit a signal.

BACKGROUND

Wired pipe telemetry systems using a combination of electrical and magnetic principles to transmit data between a downhole location and the surface are described in, for example, U.S. Pat. Nos. 6,670,880 and 6,641,434. In these systems, inductive transducers are provided at the ends of wired pipes. The inductive transducers at the ends of each wired pipe are electrically connected by an electrical conductor running along the length of the wired pipe. Data transmission involves transmitting an electrical signal through an electrical conductor in a first wired pipe, converting the electrical signal to a magnetic field upon leaving the first wired pipe using an inductive transducer at an end of the first wired pipe, and converting the magnetic field back into an electrical signal upon entering a second wired pipe using an inductive transducer at an end of the second wired pipe. Several wired pipes are typically needed for data transmission between the downhole location and the surface. Before connecting a new wired pipe to existing wired pipes in a borehole, it is desirable to test that the new wired pipe can transmit a signal. After connecting a new wired to existing wired pipes in the borehole, it may also be desirable to test that the system can transmit a signal. An apparatus and a method for accomplishing such testing is desired.

SUMMARY

In one aspect, the invention relates to a wired pipe signal transmission testing apparatus.

In one embodiment, the apparatus comprises a core having a plurality of threads formed on a surface thereof and a plurality of slots cutting through crests and roots of at least a portion of the threads, thereby creating an escape route for debris that enter in between the threads. The apparatus further comprises an inductive transducer coupled to the core.

In another embodiment, the apparatus comprises a core having a plurality of threads formed on an external surface thereof and a plurality of slots cutting through crests and roots of at least a portion of the threads, thereby creating an escape route for debris that may enter in between the threads. The apparatus further comprises an inductive transducer mounted at an end face of the core.

In yet another embodiment, the apparatus comprises a core having an annular wall and a plurality of threads formed on an inner surface of the annular wall. The core is provided with a plurality of slots that cut through crests and roots of at least a portion of the threads and through the annular wall, thereby creating an escape route for debris that may enter in between the threads. The apparatus further includes an inductive transducer mounted within the core.

In another embodiment, the apparatus comprises at least one wired pipe having a pipe end with a surface on which a plurality of pipe threads are formed and a surface on which an inductive transducer is mounted. The apparatus includes a test plug carrying an inductive transducer. The test plug has a plurality of plug threads for engaging the pipe threads and a plurality of slots cutting through crests and roots of at least a portion of the pipe threads. When a threaded connection is formed between the core threads and the pipe threads, the inductive transducers are in a position to share magnetic fields.

In another aspect, the invention relates to a wired pipe signal transmission testing method.

In one embodiment, the method includes forming a threaded connection between a first end of a wired pipe including an inductive transducer and a test plug including an inductive transducer. The test plug comprises a plurality of threads for forming the threaded connection and a plurality of slots cutting through crests and roots of at least a portion of the threads. The method includes transmitting a signal to the inductive transducer included in the test plug and measuring a signal transmitted between the inductive transducer included at the first end of the wired pipe and an inductive transducer included at a second end of the wired pipe. Other features and advantages of the invention will be apparent from the following description and the appended claims.

BRIEF DESCRIPTION OF DRAWINGS

The accompanying drawings, described below, illustrate typical embodiments of the invention and are not to be considered limiting of the scope of the invention, for the invention may admit to other equally effective embodiments. The figures are not necessarily to scale, and certain features and certain views of the figures may be shown exaggerated in scale or in schematic in the interest of clarity and conciseness.

DETAILED DESCRIPTION

Figure 1:
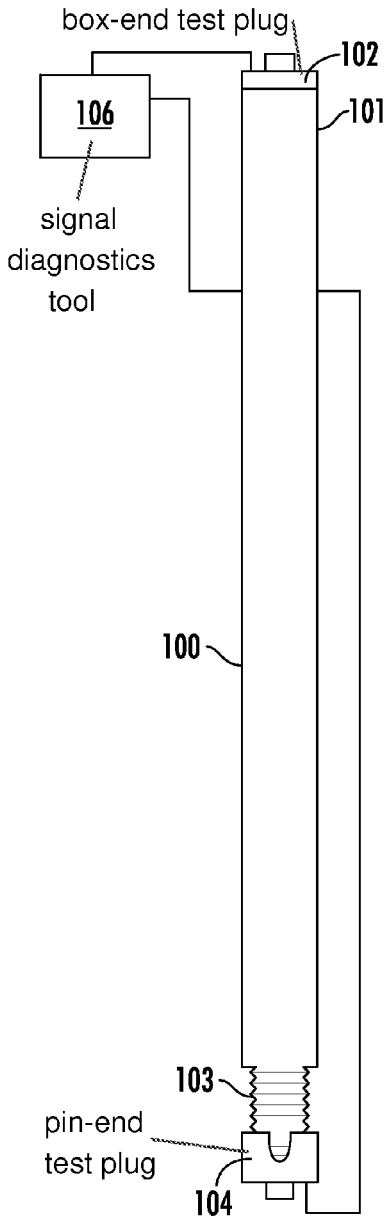
FIG. 1 is a schematic of a wired pipe and an apparatus for testing the wired pipe for its ability to transmit a signal.

The invention will now be described in detail with reference to a few embodiments, as illustrated in the accompanying drawings. In describing the embodiments, numerous specific details may be set forth in order to provide a thorough understanding of the invention. However, it will be apparent to one skilled in the art that the invention may be practiced without some or all of these specific details. In other instances, well-known features and/or process steps may not be described in detail so as not to unnecessarily obscure the invention. In addition, like or identical reference numerals may be used to identify common or similar elements.

FIG. 1 shows a wired pipe 100 that is to be tested for its ability to transmit an electrical signal. An apparatus for testing the wired pipe 100 includes a box-end test plug 102, which is mounted at the box end 101 of the wired pipe 100, and a pin-end test plug 104, which is mounted at the pin end 103 of the wired pipe 100. To test the wired pipe 100 for its ability to transmit an electrical signal, a signal diagnostics tool 106 is connected to the box-end test plug 102 and operated to transmit an electrical signal to the box-end test plug 106. If the wired pipe 100 is working properly, the electrical signal will be coupled into the wired pipe 100 and then into the pin-end test plug 104. The signal diagnostics tool 106 can be connected to the pin-end test plug 104 to measure the electrical signal coupled into the pin-end test plug 104, and the output of the signal diagnostics tool 106 can be used to verify the ability of the wired pipe 100 to transmit a signal.

Figure 2:
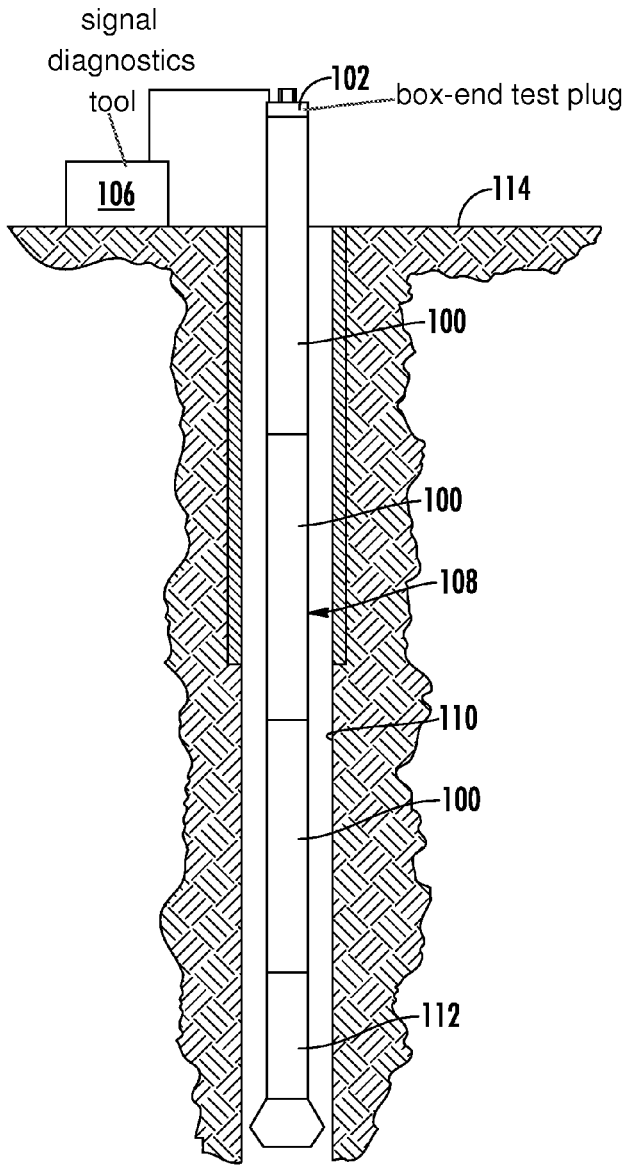
FIG. 2 is a schematic of a string of wired pipes and an apparatus for testing the string of wired pipes for its ability to transmit a signal.

In another scenario, only one of box-end test plug 102 and pin-end test plug 104, depending on the end of the wired pipe 100 available for connection to the test apparatus, may be used in the signal transmission testing. In FIG. 2, for example, a string 108 of wired pipes 100 is disposed in a borehole 110. In this case, only the box-end test plug 102 is used to test the ability of the string 108 of wired pipes 100 to transmit a signal between a downhole tool 112 at the end of the string 108 of wired pipes 100 and the signal diagnostics tool 106 at the surface 114. In the example shown in FIG. 2, the signal diagnostics tool 106 transmits an electrical signal to and receives an electrical signal from the downhole tool 112 through the box-end test plug 102. As in the previous case, the output of the signal diagnostics tool 106 can be used to verify the ability of the string 108 of wired pipes 100 to transmit a signal.

Figure 3:
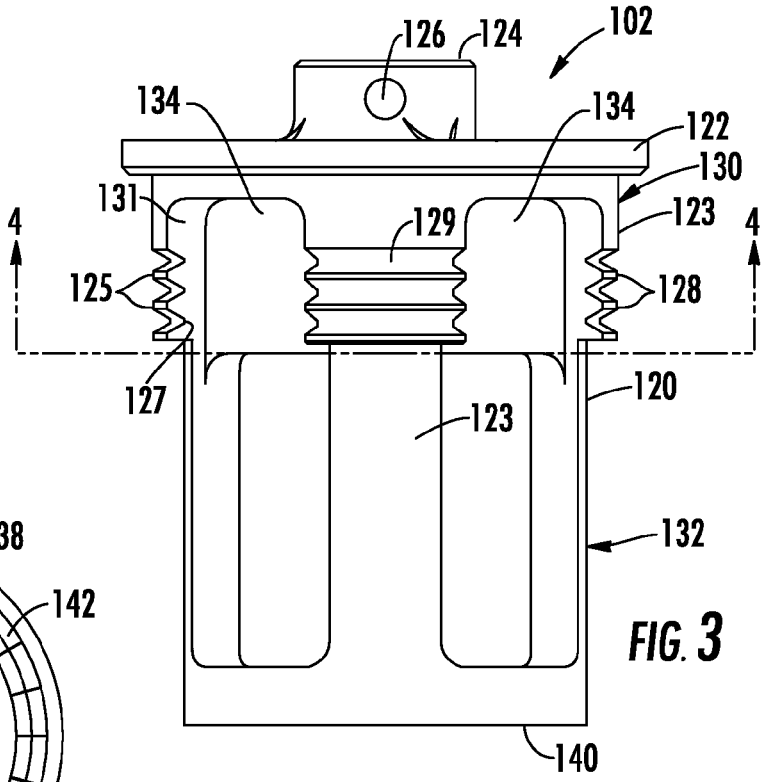
FIG. 3 is a perspective view of the box-end test plug shown in FIG. 1.

FIG. 3 is a perspective view of the box-end test plug 102 (previously shown in FIGS. 1 and 2). The box-end test plug 102 has a core or shaft 120 that terminates at one end in a head or flange 122. The core 120 may have a generally cylindrical shape, which in some examples may be tapered. The head 122 may include a knob 124 having, for example, a hole 126 to facilitate insertion of a handling tool (not shown). Screw threads 128 are formed on the external surface 123 of the core 120. In the example shown in FIG. 3, the threads 128 are formed in an upper portion 130 of the core 120, the upper portion 130 being the portion of the core 120 closest to the head 122. In other examples, the threads 128 may be formed in the lower portion 132 of the core 120. The purpose of the threads 128 is to allow the box-end test plug 102 to be connected to the box end of a wired point joint that includes similar threads. Thus, only enough threads to form a threaded engagement between the box-end test plug 102 and a box end of a wired pipe need be formed on the core 120 of the box-end test plug 102. The design of the threads 128 will be selected to match that of the box end of the wired pipe to be tested.

The screw threads 128 on the core 120 are segmented by a plurality of slots 134 that cut through the crests 125 and roots 127 of the threads 128 into the core 120. The angle each slot 134 makes with the screw threads 128 is such that each slot 134 cuts through the crests 125 and roots 127 of a majority, preferably all, of the screw threads 128. Each slot 134 cuts through the crests 125 and roots 127 of at least 50% of the screw threads 128 (measured from the lowermost screw thread 128), preferably greater than 75% of the screw threads 128 (measured from the lowermost screw thread 128), more preferably greater than 90% of the screw threads 128 (measured from the lowermost screw thread 128). The lowermost screw thread 128 is the screw thread 128 that is farthest from the head 122. In one example, the slots 134 transversely intersect the crests 125 and roots 127 of the screw threads 128 at approximately 90° (i.e., substantially perpendicularly), e.g., as shown in FIG. 3. In other examples, the slots 134 may transversely intersect the crests 125 and roots 127 of the screw threads 128 at angles other 90° provided that the slots 134 cut through the crests 125 and roots 127 of a majority of the screw threads 128 as described above. The slots 134 are connected to the channels 129 between adjacent threads 128. This allows the slots 134 to receive debris that fall into the channels 129 between adjacent threads 128. Such debris may be encountered while making up a threaded connection between the box-end test plug 102 and a box end of a wired pipe.

Figure 4:
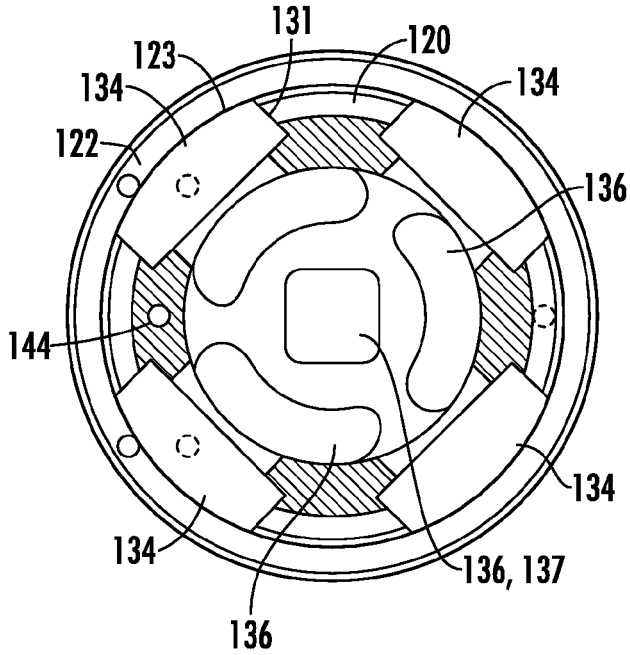
FIG. 4 is a cross-sectional view of the box-end test plug of FIG. 3 along lines 4-4.

The slots 134 are distributed about the circumference of the core 120 at selected offsets. In some examples, the slots 134 are equally spaced about the circumference of the core 120. In other examples, the slots 134 are unequally spaced about the circumference of the core 120. As shown in FIG. 4, in one example, four slots 134 are distributed about the circumference of the core 120 at 90° offsets. In other examples, more of fewer slots 134 may be distributed about the circumference of the core 120. In some examples, the sidewalls 131 of the slots 134 are slanted outwardly relative to the external surface 123 of the core 120. The slant angles may be between 20° and 80°, preferably between 30° and 60°, and more preferably approximately 45°, where the slant angles are measured from the external surface 123. The slots 134 cut through the lowermost screw thread 128, thereby creating an escape route for debris received in the slots 134, i.e., debris received in the slots 134 can fall down the external surface 123 of the core 120.

Figure 5:
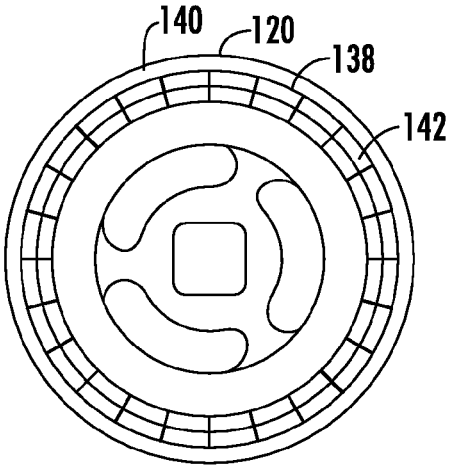
FIG. 5 is an end view of the box-end test plug of FIG. 3.

Weight-reducing slots 136 may be formed in the core 120 and head 122 to reduce the overall weight of the box-end test plug 102. In one example, as shown more clearly in FIG. 4, four weight-reducing slots 136 are formed in the core 120. The weight-reducing slot 136 at the center, indicated at 137, extends into the knob 124 of the head 122. In general, as many weight-reducing slots 136 as desired without hampering the structural integrity of the box-end test plug 102 may be used. Referring to FIG. 5, an annular groove 138 is provided at the bottom face 140 of the core 120. Inside the groove 138 is disposed an inductive transducer 142. Any suitable inductive transducer 142 for converting an electrical signal to a magnetic field may be used, such as described, for example, in U.S. Pat. No. 6,670,880 issued to Hall et al. In the Hall et al. patent, the inductive transducer 142 included a magnetically-conductive electrically insulating element (MCEI) having a U-shaped trough in which is located an electrically conducting coil. A varying current applied to the electrically conducting coil generates a varying magnetic field in the MCEI. The core 120 includes a conduit 144 (shown in FIG. 4) that extends from the head 122 (shown in FIG. 3) to the groove 138 and through which an electrical wire (not shown) can be connected to an electrically conducting coil (not shown separately) in the inductive transducer 142.

Figure 6:
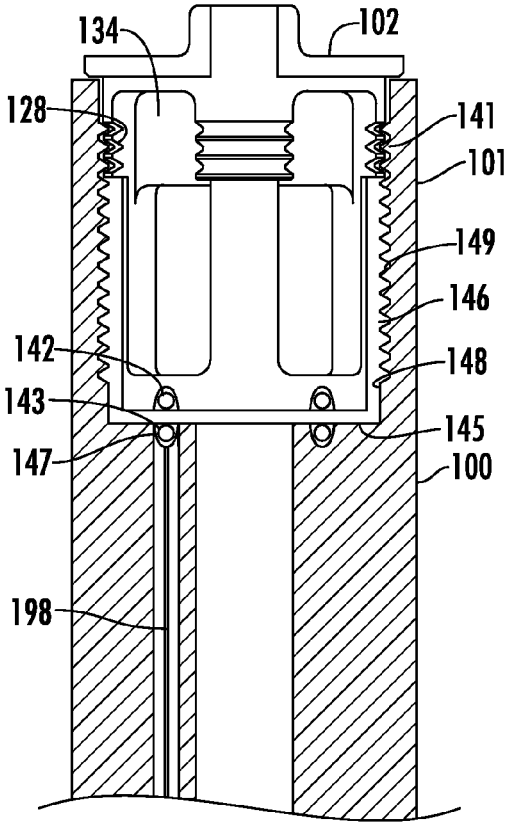
FIG. 6 is a schematic of a threaded connection between a box end of a wired pipe and the box-end test plug of FIG. 3.

FIG. 6 shows a threaded connection 141 between the box-end test plug 102 and the box end 101 of the wired pipe 100. The box end 101 of the wired pipe 100 includes an inner chamber 146 defined by an annular wall 148. The shape of the box-end test plug 102 is such that it can be received in the inner chamber 146. Threads 149 are formed on the annular wall 148. The bottom surface 145 of the inner chamber 146 includes a groove 147 in which an inductive transducer 143 is mounted. The inductive transducer 143 may be as described above for the box-end test plug. To test the wired pipe 100, it is necessary for the inductive transducer 143 in the box end 101 of the wire pipe joint 100 to come into close proximity with the inductive transducer 142 in the box-end test plug 102 so that the inductive transducers 142, 143 can share magnetic field. Thus, the location of the threads 128 on the box-end test plug 102 is such that when a threaded connection is formed between the box-end test plug 102 and the box end 101 of the wired pipe 100, the inductive transducers 142, 143 are in close proximity. To allow such a threaded connection to be successfully made up, slots 134 are provided in the box-end test plug 102, as described above, to clean out any debris that fall into the channels between the threads 128 of the box-end test plug 102 from between the threads 128, 149.

Figure 7:
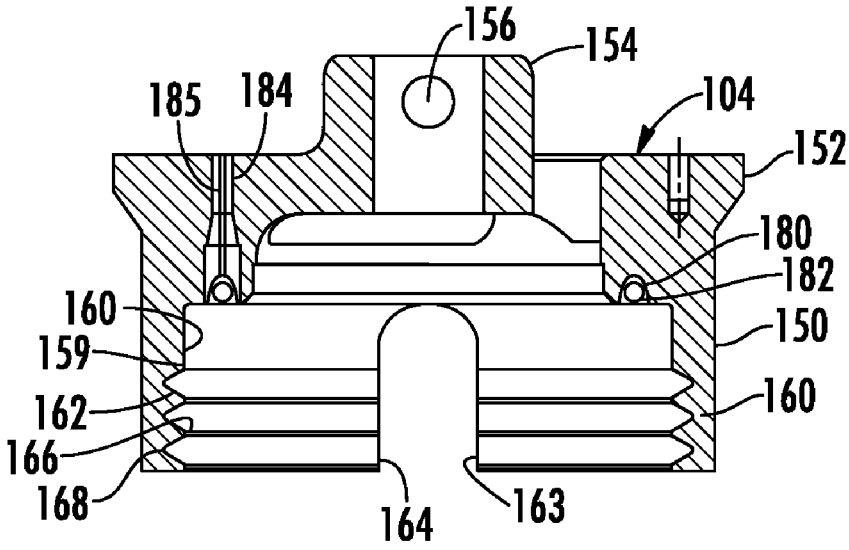
FIG. 7 is a cross-sectional view of a pin-end test plug.

FIG. 7 is a cross-sectional view of the pin-end test plug 104 (previously shown in FIG. 1). The pin-end test plug 104 has a core or shaft 150 that terminates at one end in a head or flange 152. The core 150 may have a generally cylindrical shape, which in some examples may be tapered. The head 152 may include a knob 154 having, for example, a hole 156 to facilitate insertion of a handling tool (not shown). The core 150 has an annular wall 160 defining an inner chamber 158. Screw threads 162 are formed on the inner surface 159 of the annular wall 160. The purpose of the screw threads 162 is to allow the pin-end test plug 104 to be connected to the pin end of a wired pipe that includes similar threads. Only enough threads to form a threaded engagement between the pin-end test plug 104 and a pin end of a wired pipe need to be formed on the internal surface 159 of the annular wall 160. That is, threads may be formed on a portion of the length or the entire length of the internal surface 159 as deemed necessary. The design of the screw threads 162 will be selected to match that of the pin end of the wired pipe to be tested.

The screw threads 162 on the internal surface 159 of the annular wall 160 are segmented by a plurality of slots 164 that cut through the crests 166 and roots 168 of the threads 162 and through the annular wall 160. The slots 164 are through slots in that they extend from the external surface 170 of the core 150 to the inner chamber 158 of the core 150. In one example, the slots 150 transversely intersect the crests 166 and roots 168 of the threads 162 at approximately 90° (i.e., substantially perpendicularly). In other examples, the slots 150 may transversely intersect the crests 166 and roots 168 of the threads 162 provided that the slots 150 cut through the crests 166 and roots 168 of a majority of the threads 162. Each slot 150 cuts through the crests 166 and roots 168 of at least 50% of threads 162 (measured from the lowermost thread 162), preferably greater than 75% of the screw threads 162 (measured from the lowermost screw thread 162), more preferably greater than 90% of the screw threads 162 (measured from the lowermost screw thread 162). The lowermost screw thread 162 is the screw thread 162 that is farthest from the head 152.

In the disclosed example, two diametrically-opposed slots 164 (see also FIG. 8) as described above are formed in the pin-end test plug 104. In general, any number of slots 164 may be formed in the pin-end test plug 104 provided there is enough thread surface remaining on the core 150 to form a threaded connection with a wire pipe joint (not shown) and the pin-end test plug 104 has sufficient structural strength. In one example, the sidewalls 163 of the slots 164 are slanted inwardly relative to the external surface 170 of the core 150. That is, the angle between the sidewalls 163 and the external surface 170 (measured from the external surface 170) is greater than 90°. In one example, the sidewalls 163 of the slots 164 form an angle of 95° with the external surface 170 of the core 150, where the slant angle is measured from the external surface 170. The slots 164 function similarly to the cleaning slots (134 in FIG. 3) described for the box-end test plug (102 in FIG. 3). That is, debris in the channels 172 between adjacent threads 162 and fall into the slots 164. When the pin-end test plug 104 is being made up with a pin end of a wired pipe, the debris falling into the slots 164 will be able to fall down the wired pipe and away from the threaded connection that is being made up between the pin-end test plug 104 and the pin end of the wired pipe.

Figure 8:
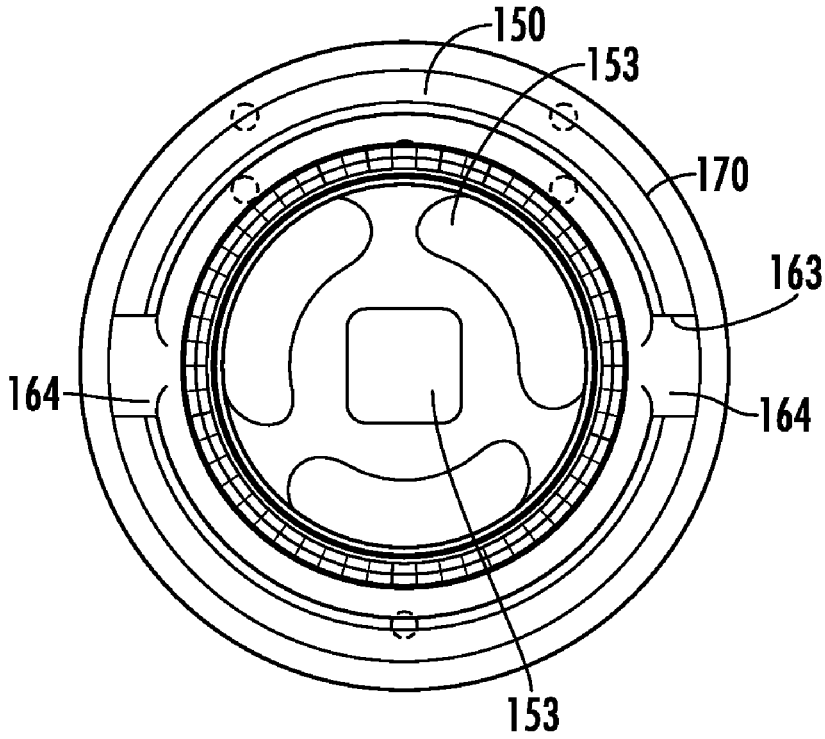
FIG. 8 is an end view of the pin-end test plug of FIG. 7.

Weight reducing slots 153 may be formed in the portion of the core 150 above the inner chamber 158 and in the head 152. An annular groove 180 is formed in the core 150 above the inner chamber 158. As shown in FIG. 8, the groove 180 holds an inductive transducer 182 as described above for the box-end test plug (102 in FIG. 5). Referring to FIG. 7, a conduit 184 runs from the head 152 to the groove 180 and is used to pass an electrical wire 185 to an electrical conducting coil (not shown separately) of the inductive transducer 182 as described above for the box-end test plug.

Figure 9:
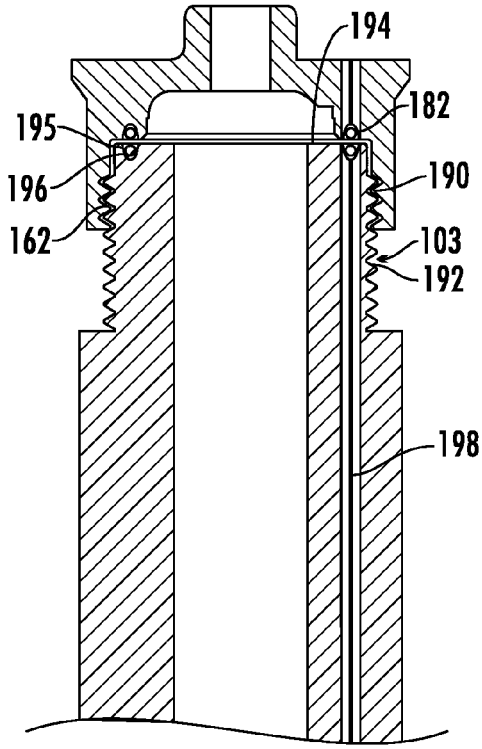
FIG. 9 is a schematic of a threaded connection between a pin end of a wired pipe and the pin-end test plug of FIG. 7.

FIG. 9 shows a threaded connection 190 between the pin-end test plug 104 and a pin end 103 of the wire pipe joint 100 (previously shown in FIG. 1). The external surface of the pin end 103 of the wire pipe joint 100 is provided with threads 192. The end face 194 of the pin end 103 of the wire pipe joint 100 includes a groove 195 in which an inductive transducer 196 is mounted. The inductive transducer 194 may be as described above for the pin-end test plug 104 and box-end test plug. For completeness, it should be noted that an electrical conductor 198 runs from the inductive transducer 194 in the pin end 103 of the wire pipe joint 100 to the inductive transducer (143 in FIG. 6) in the box end (101 in FIG. 6) of the wire pipe joint 100. To test the wire pipe joint 100, it is necessary for the inductive transducer 196 in the pin end 103 of the wire pipe joint 100 to come into close proximity with the inductive transducer 182 in the pin-end test plug 104 so that the inductive transducers 182, 196 can share magnetic fields. Thus, the location of the threads 162 on the pin-end test plug 104 is such that when the threaded connection 190 is formed between the pin-end test plug 104 and the pin end 103 of the wired pipe 100, the inductive transducers 182, 196 are in close proximity. To allow such a threaded connection to be successfully made up, slots 164 are provided in the pin-end test plug 104, as described above, to clean out any debris that fall into the channels between the threads 162 of the pin-end test plug 104 from between the threads 162, 192.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A wired pipe signal transmission testing apparatus, comprising:

a core having a plurality of threads formed on a surface thereof, wherein the plurality of threads comprise a plurality of crests and a plurality of roots;

a plurality of circumferentially spaced slots in the core, wherein each slot cuts through a majority of the crests and a majority of the roots of the plurality of threads, thereby creating an escape route for debris that may enter between the plurality of threads; and an inductive transducer coupled to the core.

2. The apparatus of claim 1, wherein the threads are formed on an external surface of the core.

3. The apparatus of claim 2, wherein the slots cut through the crests and roots of the threads substantially perpendicularly.

4. The apparatus of claim 2, wherein the slots have sidewalls which are slanted outwardly relative to the external surface of the core.

5. The apparatus of claim 1, wherein a groove is formed in an end face of the core for holding the inductive transducer.

6. The apparatus of claim 5, wherein a conduit is formed in the core for passing an electrical wire to the inductive transducer in the groove.

7. The apparatus of claim 1, wherein the slots are distributed about a circumference of the core.

8. The apparatus of claim 1, wherein the threads are formed on an internal surface of the core.

9. The apparatus of claim 8, wherein the internal surface defines a chamber within the core.

10. The apparatus of claim 9, wherein the slots cut through an annular wall of the core including the internal surface.

11. The apparatus of claim 10, wherein a groove is formed next to the chamber for holding the inductive transducer.

12. The apparatus of claim 11, wherein the slots have sidewalls which are slanted inwardly relative to an external surface of the core.

13. A wired pipe signal transmission testing apparatus, comprising:

a core having a central axis, a first terminal end, a second terminal end opposite the first terminal end, and a radially outer surface, wherein the first terminal end comprises an annular flange;

a plurality of threads formed on the radially outer surface axially between the first terminal end and the second terminal end;

a plurality of slots cutting through crests and roots of at least a portion of said threads, thereby creating an escape route for debris that may enter between said threads; and an inductive transducer mounted to the second terminal end of the core.

14. A wired pipe signal transmission testing apparatus, comprising:

a core having a central axis, a first terminal end, a second terminal end opposite the first terminal end, and an annular wall extending axially from the second end and having a radially inner surface and a radially outer surface, wherein the first terminal end comprises a head that extends radially from the central axis to the annular wall;

a plurality of threads formed on the radially inner surface of the annular wall, said core being provided with a plurality of slots that cut through crests and roots of at least a portion of said threads and through the annular wall, thereby creating an escape route for debris that may enter between said threads; and an inductive transducer mounted within the core.

15. A wired pipe signal transmission testing apparatus, comprising:

a wired pipe having a box-end and a pin-end opposite the box-end, wherein the box-end includes a plurality of internal pipe threads and a surface on which a first inductive transducer is mounted, and wherein the pin-end includes a plurality of external pipe threads and a surface on which a second inductive transducer is mounted;

a first test plug coupled to the box-end of the wired pipe, wherein the first test plug has a first terminal end axially adjacent the box-end, a second terminal end disposed within the box- end, and a third inductive transducer configured to communicate with the first inductive transducer mounted to the box-end, wherein the first test plug has a plurality of external plug threads for engaging the internal pipe threads and a plurality of slots cutting through crests and roots of at least a portion of said external plug threads; and a second test plug coupled to the pin-end of the wired pipe, wherein the second test plug has a first terminal end axially adjacent the pin-end, a second terminal end disposed about the pin-end, and a fourth inductive transducer configured to communicate with the second inductive transducer mounted to the pin-end, wherein the second test plug has a plurality of internal plug threads for engaging the external pipe threads and a plurality of slots cutting through crests and roots of at least a portion of said internal plug threads;

wherein when a threaded connection is formed between the external threads of the first plug and the internal pipe threads, the inductive transducers of the box-end and the first plug are in a position to share magnetic fields, and when a threaded connection is formed between the internal threads of the second plug and the external pipe threads, the inductive transducers of the pin-end and the second plug are in a position to share magnetic fields.

16. A wired pipe signal transmission testing method, comprising:

forming a first threaded connection between a first end of a wired pipe and a first test plug; wherein the first end of the wired pipe includes a first inductive transducer and the second end at of the wired pipe includes a second inductive transducer; and wherein the first test plug comprises:

a third inductive transducer;

a plurality of first threads for forming the first threaded connection;

the plurality of threads comprising a plurality of crests and a plurality of roots; and a plurality of circumferentially spaced first slots, wherein each of the first slots cuts through a majority of the crests and a majority of the roots of the first threads;

transmitting a signal to the third inductive transducer included in first test plug; and measuring a signal transmitted between the first inductive transducer included at the first end of the wired pipe and the second inductive transducer included at the second end of the wired pipe.

17. The method of claim 16, further comprising forming a second threaded connection between the second end of the wired pipe and a second test plug including a fourth inductive transducer, said second test plug comprising a plurality of second threads for forming said second threaded connection and a plurality of second slots cutting through crests and roots of at least a portion of said second threads.

* * * * *